United States Patent [19]

Kotegawa, deceased et al.

[11] Patent Number: 4,995,566

[45] Date of Patent: Feb. 26, 1991

[54] REEL

[75] Inventors: Katsumi Kotegawa, deceased, late of Katano, by Ikuyo Kotegawa, Tetsuya Kotegawa, Takeshi Kotegawa, Toshiki Kotegawa, heirs; Yoshihiro Okuda, Osaka; Masaru Uera, Neyagawa; Hirofumi Miki, Daito, all of Japan

[73] Assignee: Tsubakimoto Chain Co., Japan

[21] Appl. No.: 512,089

[22] Filed: Apr. 11, 1990

Related U.S. Application Data

[63] Continuation of Ser. No. 297,163, Jan. 13, 1989, abandoned.

[30] Foreign Application Priority Data

Jan. 13, 1988 [JP] Japan ..... 63-6513

[51] Int. Cl.[5] ..... B65H 75/20

[52] U.S. Cl. ..... 242/77.2; 242/77

[58] Field of Search ..... 242/77.2, 118.7, 77, 242/118.4

[56] References Cited

U.S. PATENT DOCUMENTS

| | | | |
|---|---|---|---|
| 1,103,519 | 7/1914 | Lachman | 242/77.2 |
| 1,302,262 | 4/1919 | Wirt | 242/77.2 |
| 2,080,355 | 5/1937 | Geer | 242/77.2 |
| 2,973,915 | 3/1961 | Elow | 242/77.2 |
| 3,977,622 | 8/1976 | Fecher | 242/77.2 |
| 4,032,078 | 6/1977 | Van de Loock | 242/77.2 |
| 4,089,485 | 5/1978 | Van de Loock | 242/77.2 |

FOREIGN PATENT DOCUMENTS

| | | | |
|---|---|---|---|
| 10037 | of 1891 | United Kingdom | 242/77 |
| 283914 | 6/1928 | United Kingdom | 242/77.2 |
| 379411 | 9/1932 | United Kingdom | 242/77.2 |

*Primary Examiner*—William A. Cuchlinski, Jr.
*Assistant Examiner*—J. Rhea
*Attorney, Agent, or Firm*—Howson & Howson

[57] ABSTRACT

A reel for a chain or the like comprises a core portion adapted to have a chain wound around it and a pair of flange portions arranged at opposite ends of the core portion for retaining the chain on the core portion. The core and flange portions are constituted by a plurality of bent rods bonded together. Each of the bent rods comprises a central portion forming part of the core of the reel and a pair of side portions at its opposite ends forming parts of the chain-retaining flanges of the reel. The reel is inexpensive to manufacture, and can be dipped in rust-preventive fluid along with the chain, thereby eliminating the necessity of winding a chain onto a special reel for rust treatment and then rewinding the chain onto another reel for storage or shipment.

4 Claims, 10 Drawing Sheets

REEL

CROSS REFERENCE TO RELATED APPLICATION

This is a continuation of U.S. patent application Ser. No. 297,163, filed Jan. 13, 1989, now abandoned.

BRIEF DESCRIPTION OF THE INVENTION

This invention relates to reels, and more particularly to a novel and advantageous reel having particular utility for storing and carrying chains.

In the manufacture and transportation of elongated chains, the chains are usually wound onto disposable reels. The reels used in the past for this purpose typically comprise a hollow cylindrical paper core with wooden flanges at both ends held together by bolts extending through the core. These reels are structurally complicated and costly to make. Their manufacturing cost adds to the overall cost of the chain.

Aside from the structural complexity of the reels and their high manufacturing cost, the prior reels also contribute to the high cost of chain manufacture because they tend to absorb rust-preventive fluids. Thus, in order to carry out treatment of a chain with a rust-preventive fluid such as an oil, the chain is first wound onto a metal reel, and the metal reel and chain are both dipped into a bath of the fluid. Then the treated chain is wound onto the disposable reel. The necessity of winding the chain onto two reels in the rust-prevention process renders the operation inefficient as a whole.

One object of the present invention is to provide a reel for winding chains and the like which is structurally simple and inexpensive to manufacture. Another object of the invention is to simplify, and reduce the cost of, rust preventive treatments of chains.

The reel in accordance with the invention comprises a core and a pair of flanges, one at each end of the core. The core and flange structure is made up of a plurality of bent rods secured together, each rod preferably having a central portion forming part of the core, and end portions forming parts of the flanges. In the preferred embodiments of the reel, the several bent rods are substantially identical to one another and the reel is symmetrical about one or more planes in which the axis of the core lies.

DETAILED DESCRIPTION

Figure 11:
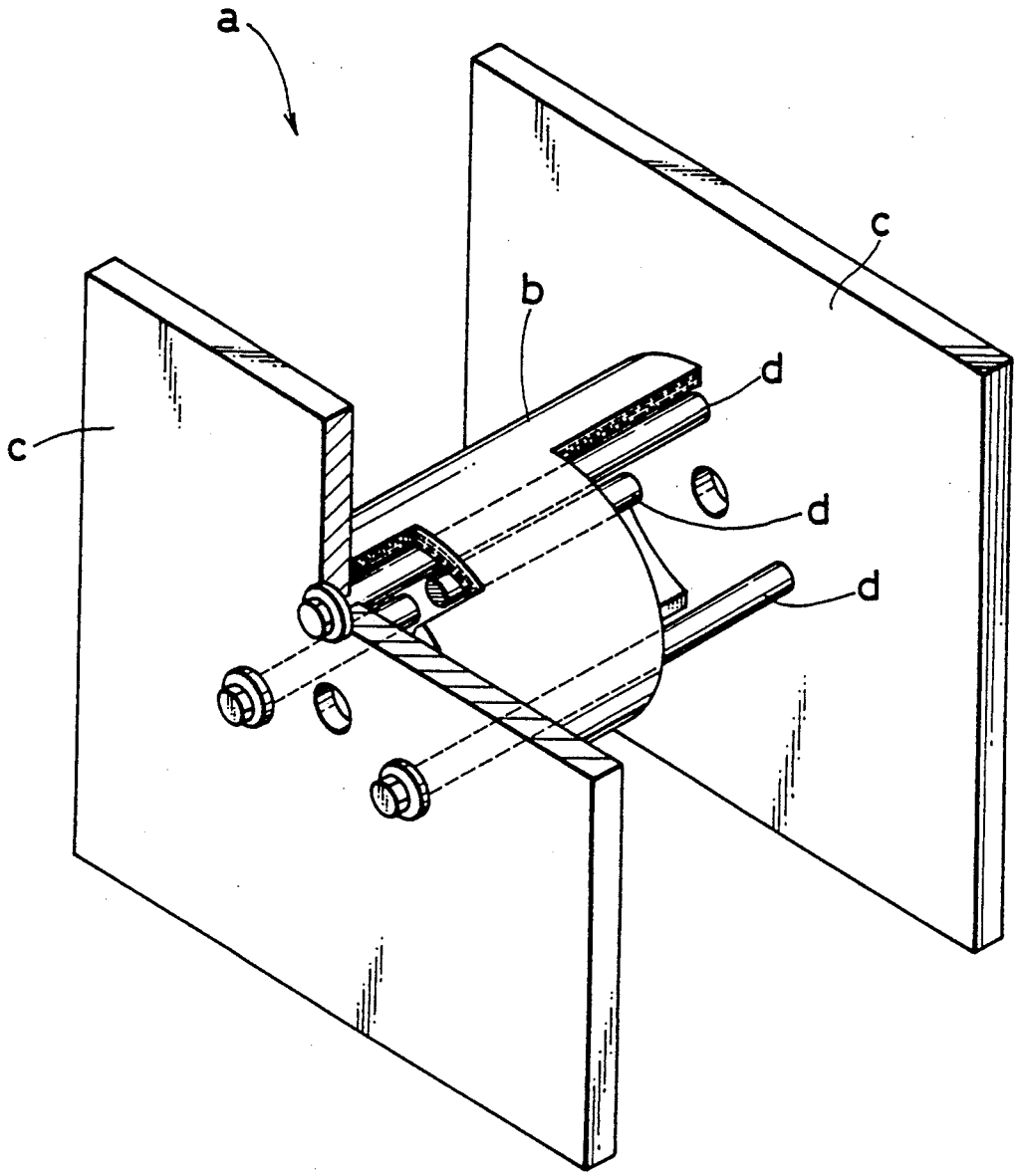
FIG.11 (PRIOR ART)
FIG. 11 is a perspective view, partly in section, showing a conventional reel in accordance with the prior art.

Referring first to FIG. 11, a conventional chain-carrying reel a comprises a hollow cylindrical core b made of paper, and a pair of wooden flanges c. These flanges are secured to the ends of the core b by bolts d which extend through the paper core and connect the flanges c together.

Figure 13:
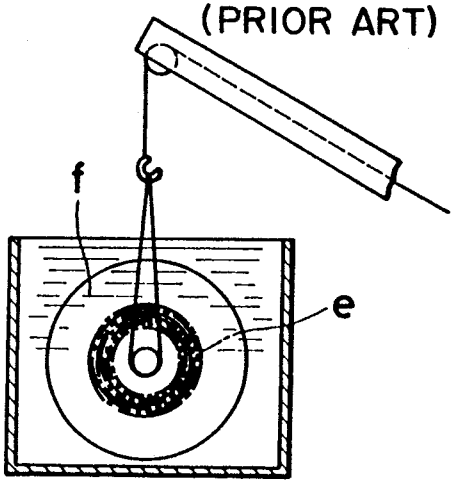
FIG. 13 (PRIOR ART)
FIGS. 12–14 are schematic views illustrating the steps required in conventional rust-preventive treatment in accordance with the prior art.
Figure 12:
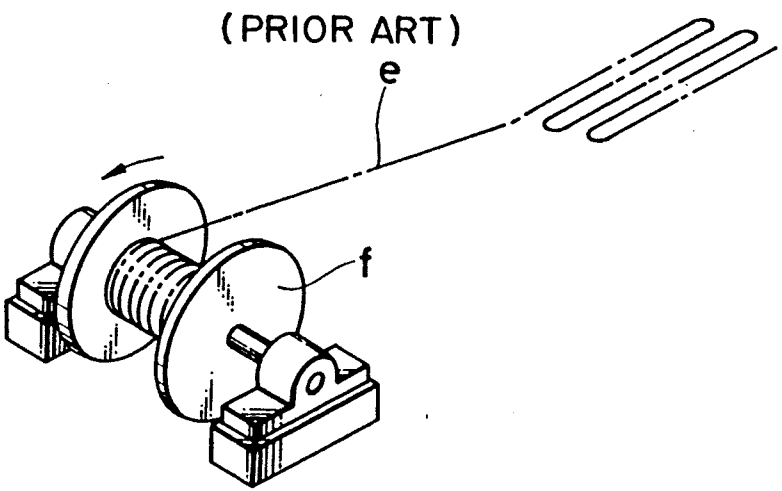
FIG. 12 (PRIOR ART)
Figure 14:
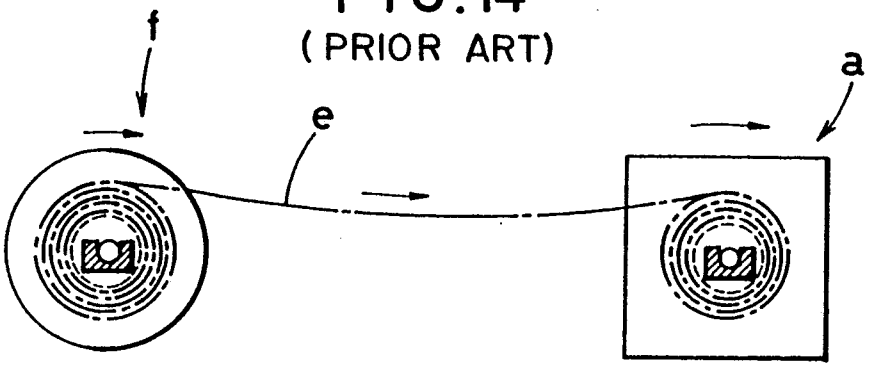
FIG. 14 (PRIOR ART)

As mentioned above, one of the problems with a reel having a paper core and wooden flanges is that these materials absorb rust preventive fluids such as oil. Thus, it is not practical to wind a chain onto one of these reels and dip the reel with the chain on it into the fluid. The conventional practice, as illustrated in FIGS. 12–14, has been to wind the chain e onto a special metal reel f, which will not absorb the rust preventive fluid. The reel f with the chain e wound on it is hoisted by a crane or other lifting device and dipped into a rust-preventive fluid such as an oil, as shown in FIG. 13. Following treatment with the rust-preventive fluid, the chain must then be unwound from the special reel f, and rewound onto a new disposable reel a, as shown in FIG. 14.

Figure 1:
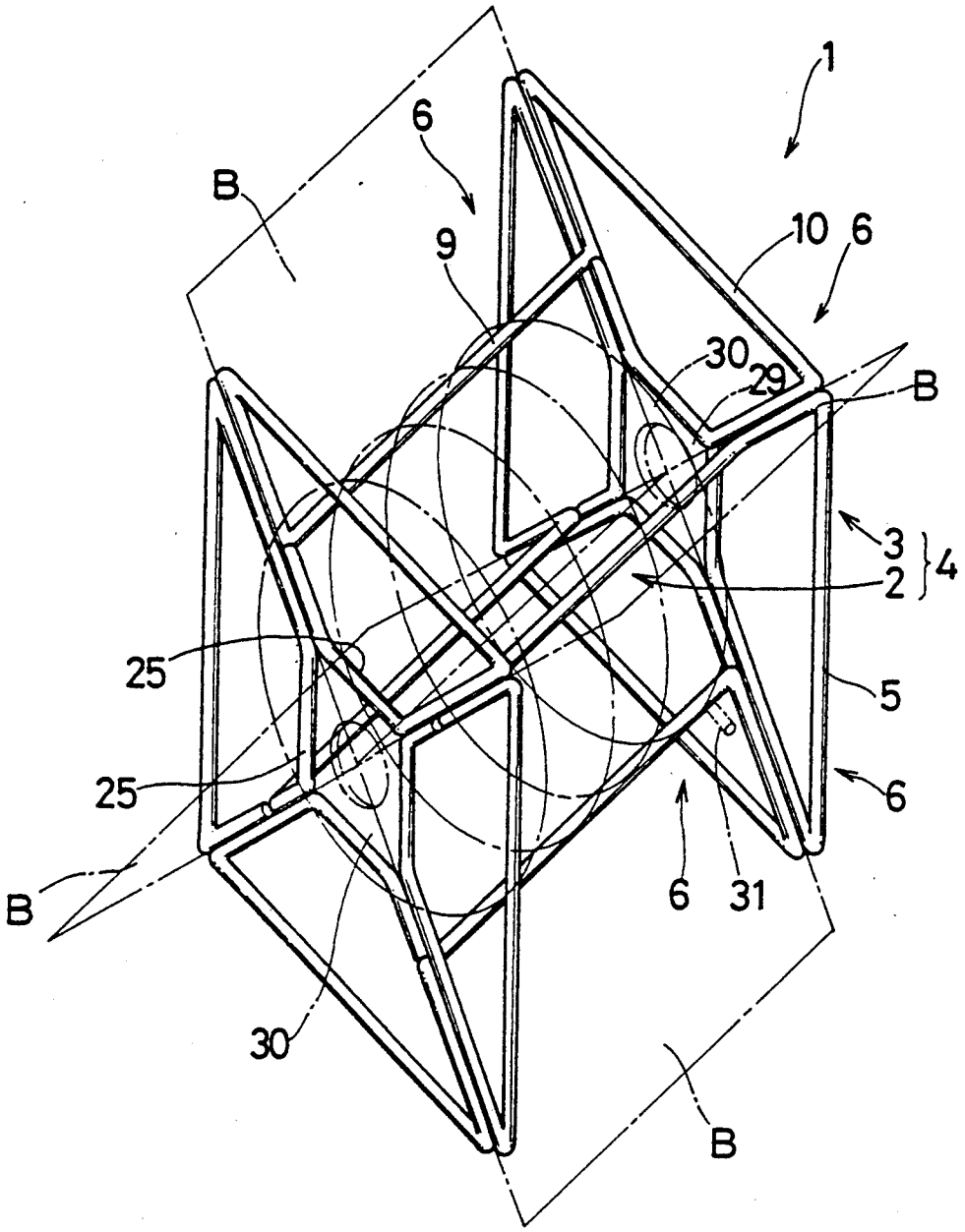
FIG. 1 is a perspective view of one embodiment of a reel in accordance with the invention.

In FIG. 1, the main body 4 of reel 1 in accordance with the invention, is formed by securing together four bent rods 6.

Figure 2:
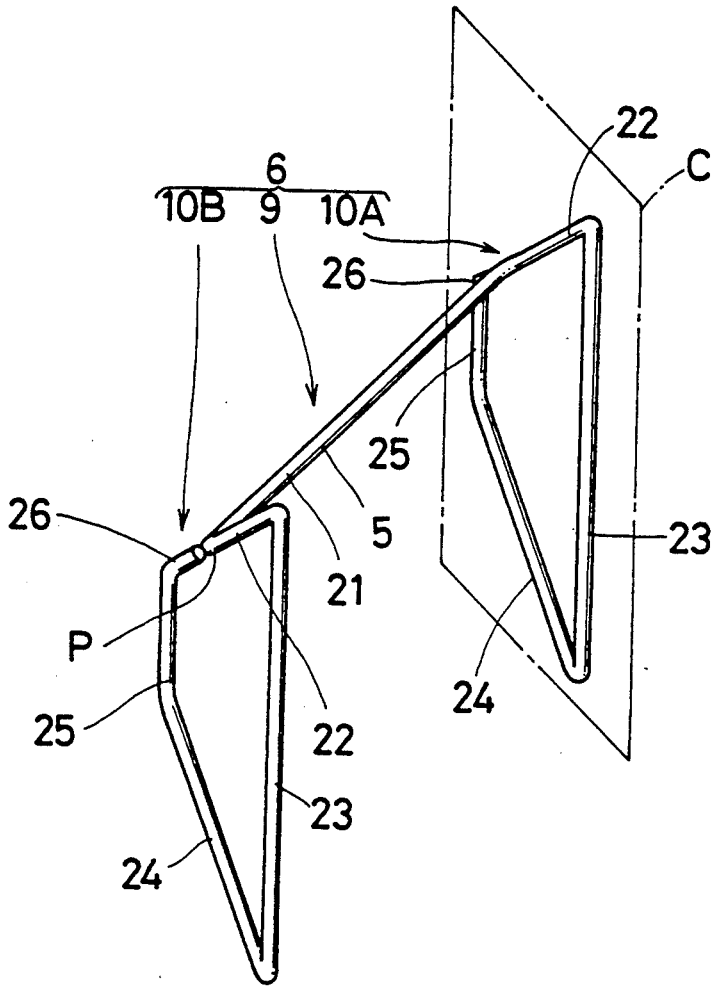
FIG. 2 is a perspective view of one of the bent rods which make up the reel of FIG. 1.
Figure 3A:
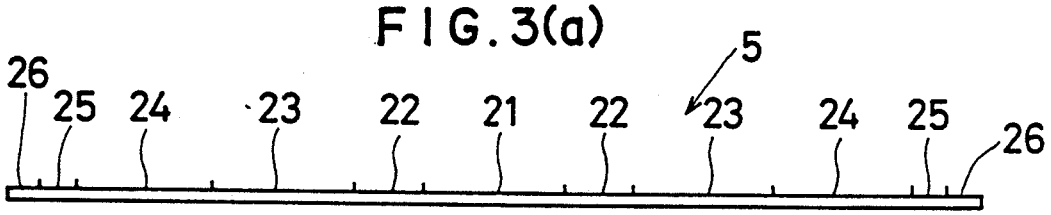
FIGS. 3(*a*)–3(*e*) are schematic views illustrating the successive steps by which a straight rod is bent to produce the bent rod of FIG. 2.
Figure 3B:
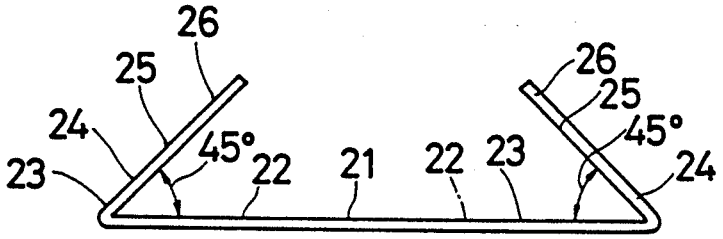
Figure 3C:
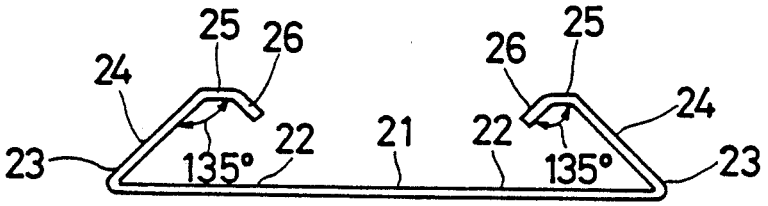
Figure 3D:
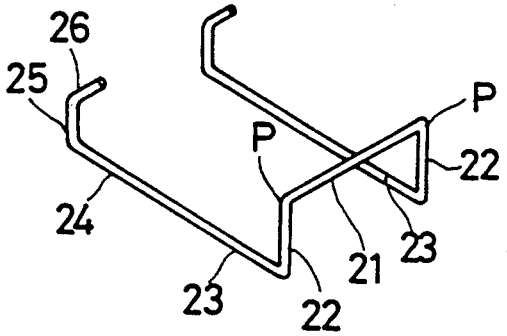
Figure 3E:
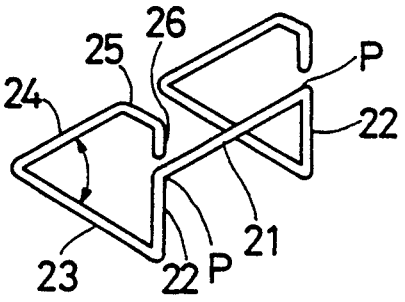

A bent rod 6, as shown in FIG. 2 may be formed by bending an elongated rod 5 of metal or a plastics material. The bent rod 6 comprises a horizontally extending central portion 21. Sloping portions 22 extend substantially perpendicularly from the ends of central portion 21 and upwardly and forwardly at an angle of approximately 45 degrees from the horizontal in vertical planes to which the central portion 21 is perpendicular. Vertical portions 23 extend downwardly from the upper ends of the sloping portions 22. Second sloping portions 24 extend upwardly and rearwardly from the lower ends of the vertical portions 23 at an angle of approximately 45 degrees relative to the vertical portions. Upright portions 25 extend from the upper ends of the sloping portions 24, and final connecting portions 26 extend from the upper ends of portions 25 to the point at which the central portion 21 meets sloping portion 22. One such meeting point is indicated at P in FIG. 2. The connecting portions 26 are preferably aligned with sloping portions 22. All of the elements 22, 23, 24, 25 and 26 preferably lie substantially in planes to which the central portion 21 is perpendicular, one such plane being indicated at C in FIG. 2.

In the embodiment shown in FIGS. 1 and 2, four bent rods, formed as shown in FIG. 2, are assembled and secured together to form the reel of FIG. 1. The central portion 21 forms a portion 9 of the core of the reel, and portions 22–26 at both ends of the central portion form portions 10A and 10B of the sides or flanges of the reel. Thus, a bent rod 6 comprises a core portion 9 and two side portions 10A and 10B.

The procedure for forming a bent rod 6 from a straight, elongated rod 5 is carried out as shown in FIGS. 3(*a*)–3(*e*).

Beginning with a straight rod 5 of appropriate length, as shown in FIG. 3(*a*), markings are made, as indicated, to divide the length of the rod into portions 21–26. The first bends are made at the locations at which portions 22 meet portions 23. Portions 23 are bent inwardly toward each other so that each portion 23 forms an angle of 45 degrees with its adjacent portion 22, with all portions of the rod remaining in a common plane.

Next, as shown in FIG. 3(*c*), portions 25 are bent at an angle of 135 degrees relative to portions 24, and connecting portions 26 are bent at an angle of 135 degrees relative to portions 25. These bending operations are preferably carried out simultaneously. Portions 25 are now parallel to portions 22, and all portions of the rod 5 are still in a common plane.

As shown in FIG. 3(*d*), portions 22 are bent at an angle of 90 degrees With respect to central portion 21. In this operation, bending takes place in a direction perpendicular to the direction of the previous bends, so that the sections comprising portions 22, 23, 24, 25 and 26 lie in spaced, parallel planes to which central portion 21 is perpendicular.

Finally, as shown in FIG. 3(*e*), portions 24 are bent relative to portions 23 at an angle of approximately 45 degrees in the above-mentioned parallel planes, so that the tips of the connecting portions 26 are brought adjacent to the points P where sloping portions 22 meet central portion 21.

The reel is constructed from four identical bent rods 6 having their side portions 10A secured together in plane C and having their opposite side portions 10B secured together in a similar plane on the opposite side of the reel.

Figure 4:
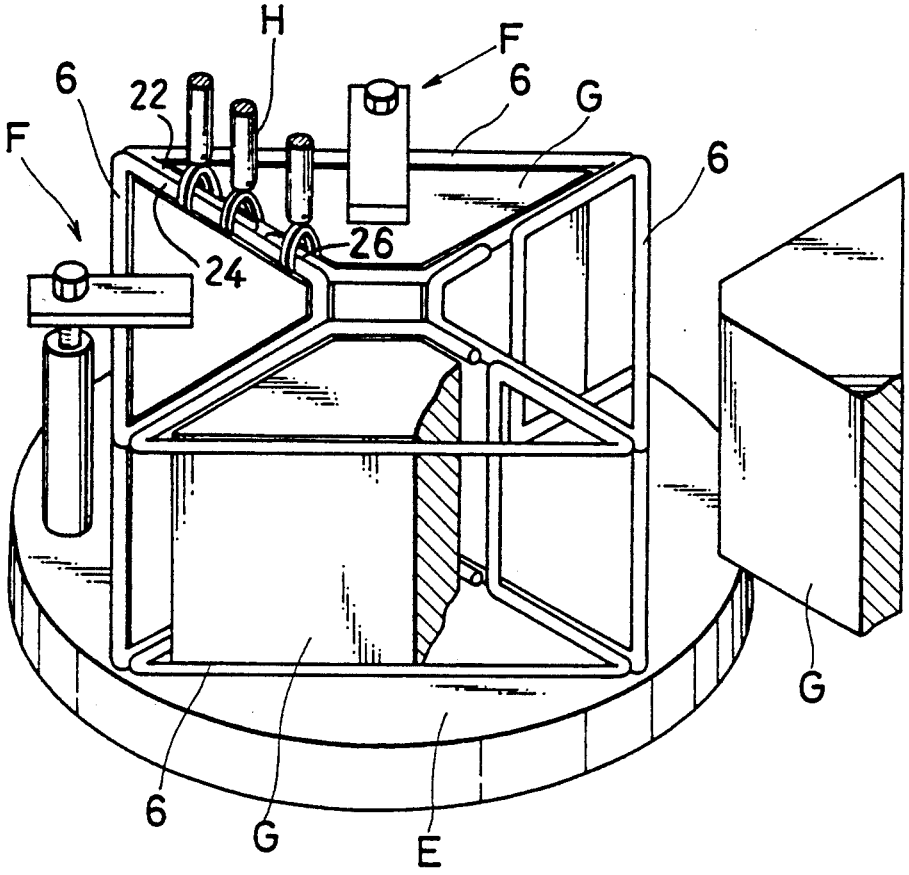
FIG. 4 is a perspective view, partially broken away, illustrating a method for securing a plurality of bent rods together to form the reel of FIG. 1.

The four bent rods which constitute the reel are secured together with the aid of a fixture as illustrated in FIG. 4. The bent rods 6 are placed on a base plate E with side portion 10A of each bent rod in contact with the base plate. The four bent rods 6 are arranged so that the sloping portions 22 of each bent rod lie against the sloping portions of the next adjacent bent rod. Each bent rod is secured against the base plate E by means of a clamp F, and blocks G are inserted into the empty spaces within each bent rod to prevent its deformation. The sloping portions 22 of each bent rod are welded to the sloping portions 24 and the connecting portions 26 of the next adjacent bent rod by means of welding electrodes H.

The assembled reel, as depicted in FIG. 1, comprises a core 2 consisting of four elongated core portions 9 formed from the central portions 21 of the rods, a flange portion 3 at one end of the core 2 formed by welding the side portions of the bent rods together, and a similar flange portion at the opposite end of the core.

The four bent rods 6 forming the reel are preferably substantially identical to each other to facilitate fabrication. The reel is preferably substantially symmetrical about planes B in which the axis of the core lies, and the four bent rods which make up the reel are welded together in planes B, the welds connecting the outwardly extending elements 21 and 26 of each end portion with the outwardly extending element 24 of an end portion of an adjacent bent rod.

As shown in FIG. 1, bearing plates 30 are preferably inserted into the rectangular spaces delineated by the four portions 25 of the bent rods at each side portion 10A and 10B. A projection 31 may be provided on one of the central portions 21 so that an end of a chain can be engaged with the reel to initiate winding of the chain onto the reel. By rotating the reel, a chain can be wound on the core while it is retained by the flange portion 3 at one end of the core, and its counterpart at the opposite end of the core.

Because the reel is formed of bent rods, a rust-preventive fluid can easily reach all portions of a chain wound on the reel to provide a uniform thin film on the chain when the reel and chain are dipped into the fluid. The reel does not absorb the fluid as is the case With a conventional reel, and because it has a comparatively small surface area, the reel carries out only a relatively small quantity of fluid as a surface coating.

Figure 5:
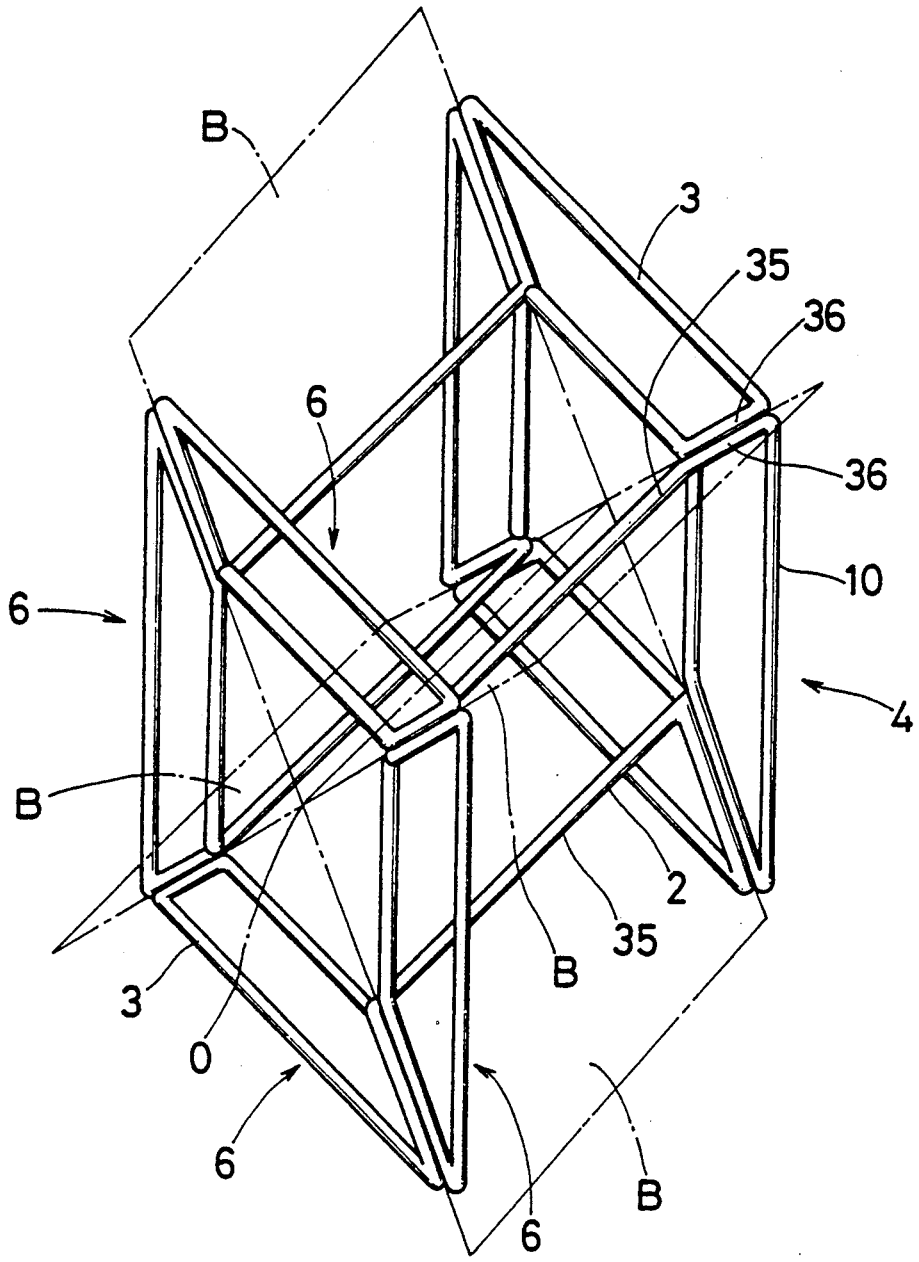
FIGS. 5–10 are perspective views showing alternative embodiments of the reel and the bent rods from which the reels are constructed.
Figure 6:
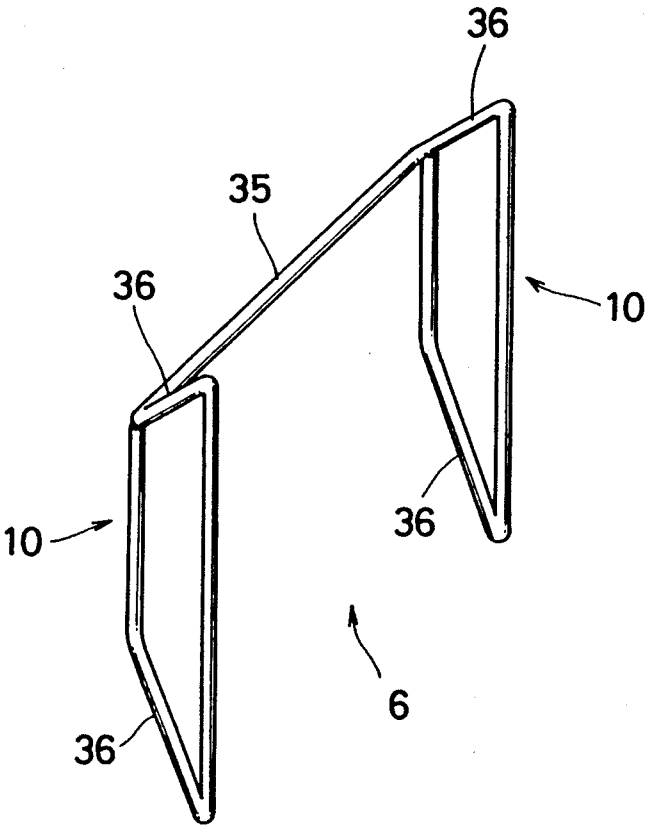

Referring to FIGS. 5 and 6, a second form of reel, as depicted in FIG. 5, comprises four substantially identical bent rods, each comprising a central portion 35 and a pair of trapezoidal side portions 10 arranged at opposite ends of the central portion. In this case, as shown in FIG. 6, the central portion 35 meets each of the trapezoidal end portions at one of the obtuse corners thereof.

The reel is formed, as shown in FIG. 6, by welding the sloping portions 36 of each bent rod to sloping portions of adjacent bent rods. The welded pairs of sloping portions extend radially and constitute parts of flange portions 3 of the reel, while the central rod portions 35 form the core 2 of the reel.

It is not necessary to use four bent rods to form the reel, as in the case of the embodiments shown in FIGS. 1 and 5. For example FIGS. 7 and 8 depict a reel comprising two substantially identical bent rods.

Figure 7:
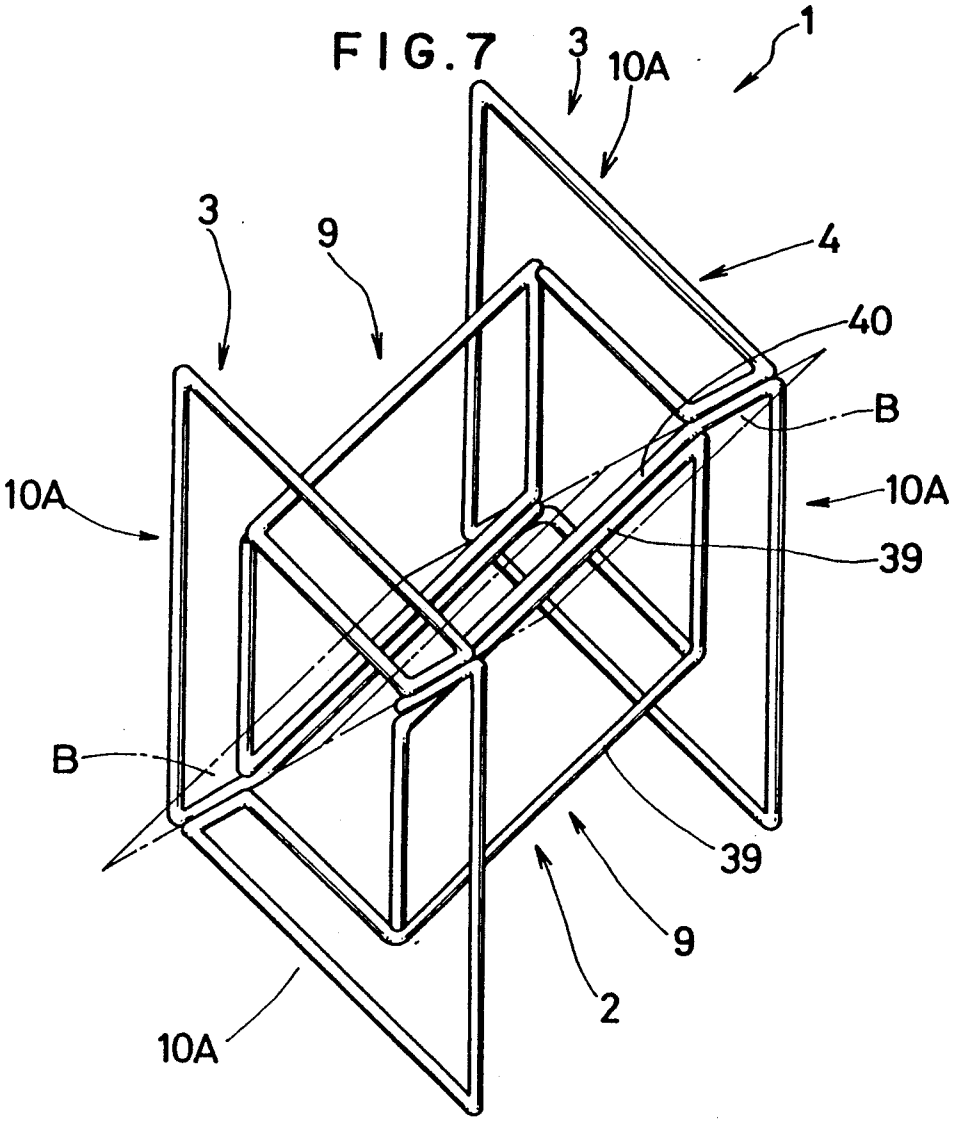
Figure 8:
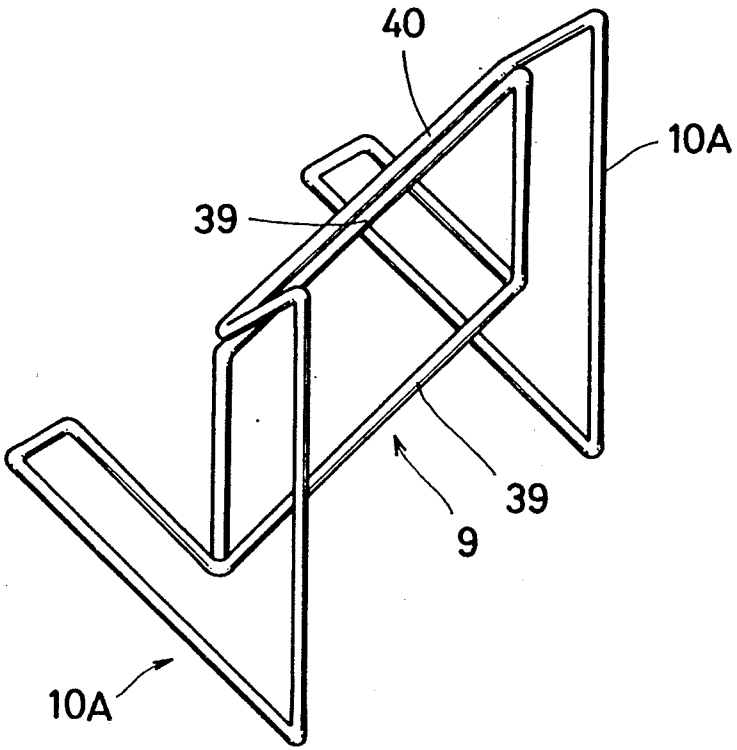

In FIGS. 7 and 8, an elongated core 9 comprises a two pair of transverse members 39, each pair being formed by bending one end of a rod into a rectangular configuration. The rest of the rod is bent to form a pair of double V-shaped side portions 10A and 10B, which are connected together by a connecting portion 40 extending along one of the transverse members 39 of the core. Radially extending elements of the side portions of the two rods are welded together to secure the two parts of the reel together.

The reel is symmetrical about plane B, in which the axis of the core of the reel lies. The two elements forming the reel are welded together in plane B.

Figure 9:
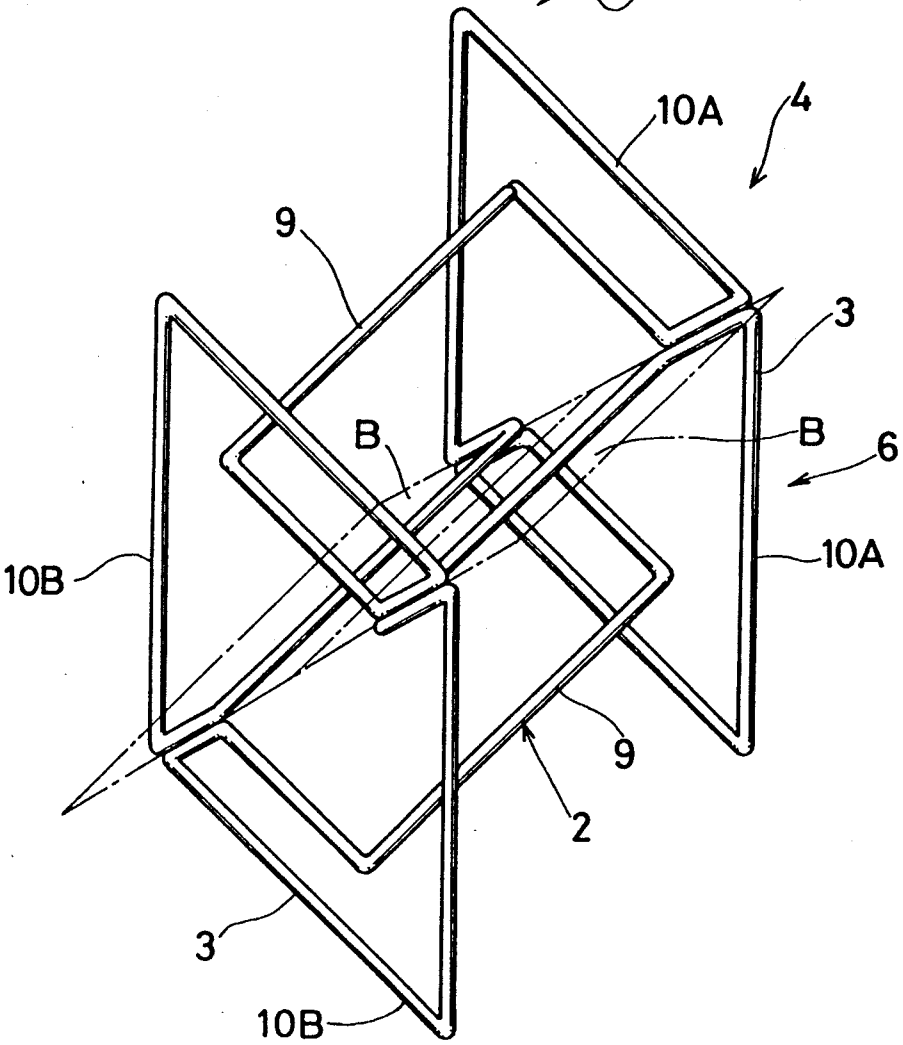
Figure 10:
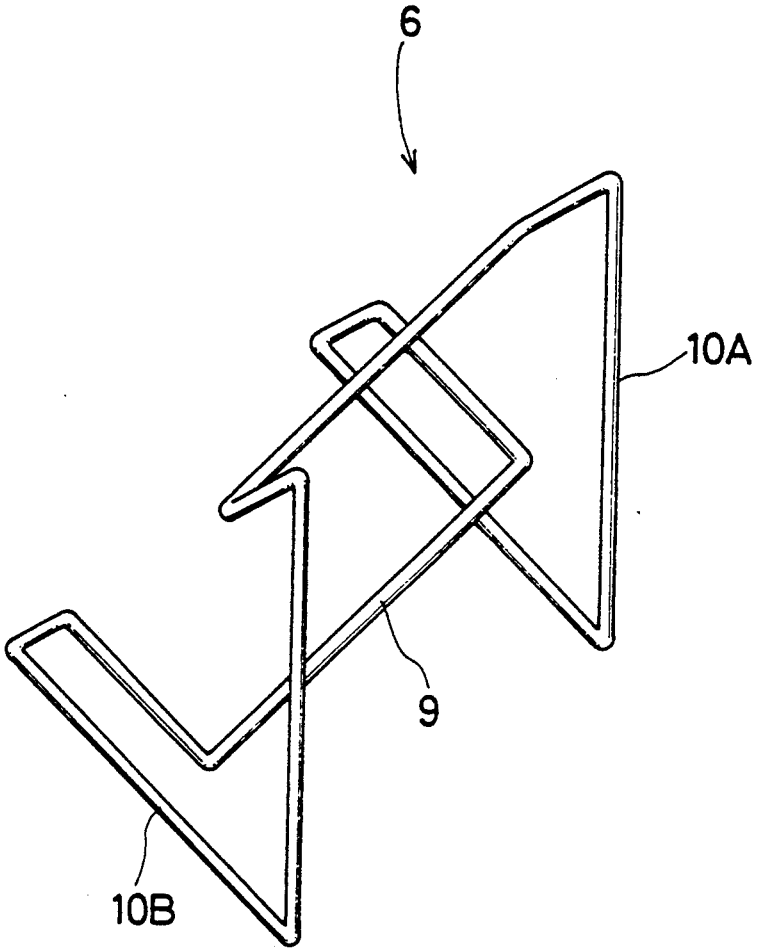

In FIGS. 9 and 10, which show still another example of a reel in accordance with the invention, each bent rod 6 comprises two side portions 10A and 10B connected by core portions 9. The rod is bent so that one end meets the other end, as shoWn in FIG. 9. In the assembly as shown in FIG. 9, the radially extending elements of the two bent rods 6 are welded together in a common plane B, and the core portions 9 together form the core, while the side portions 10A and 10B form the flanges 3.

Since, as described above, the reel comprises a plurality of bent rods bonded together preferably by welding, manufacture of the reel is simpler and less costly than the manufacture of conventional reels of the kind depicted in FIG. 11.

Rust preventive treatment of chain is greatly simplified because the reel, with the chain wound on it, can be dipped directly into a rust-preventive fluid. The fluid can readily reach and coat all parts of the surface of the chain, for improved rust prevention. The reel does not absorb the fluid and carries out relatively little of the fluid from the rust-preventive bath. The efficiency of the rust-preventive treatment is substantially improved because there is no need for rewinding the chain from one reel onto another as is the case in conventional rust treatment.

The reel of the invention need not be made of an even number of bent rods, and may be formed by bonding together odd numbers of bent rods in a variety of configurations. While in the preferred embodiments of the invention, the bent rods from which each reel is formed are substantially identical, this is not necessarily the case. For example, the core and flanges may be formed of separate, differently configured, bent rods bonded together, one rod being bent to form the core, and two rods being bent to form the flanges. While the flanges of the examples shown all lie substantially in radial planes, this is not necessarily the case. The chain-retaining elements of the flanges can be configured to lie in conical surfaces or in other surfaces of revolution. Various other modifications can be made to the invention without departing from its scope as defined in the following claims.

We claim:

1. A reel for a chain or the like comprising a core portion adapted to have a chain wound around it and a pair of flange portions arranged at opposite ends of the core portion for retaining the chain on the core portion, wherein the reel has an axis of rotation, the core and flange portions are constituted by a pair of bent rods bonded together, wherein the number of bent rods in the reel is limited to two, and wherein each bent rod comprises at least two substantially parallel core-forming elements spaced from each other, the two substantially parallel core-forming elements of each bent rod being spaced from and arranged substantially parallel to the two substantially parallel core-forming elements of the other bent rod, the core-forming elements, proceeding circumferentially around said axis, being in sequence, the two core-forming elements of one rod followed by the two core-forming elements of the other rod, and the four core-forming elements being equally spaced from said axis, whereby the core of the reel comprises at least four substantially parallel, spaced core-forming elements, in which each of said bent rods is closed upon itself to form a continuous closed loop and in which each of said bent rods has flange-forming elements at both ends of the core portion, the flange-forming elements at each end of the core portion connecting one end of one of the core-forming elements to one end of the other core-forming element.

2. A reel according to claim 1 in which the flange-forming elements at the end of each bent rod include outwardly extending elements on opposite sides of the core axis aligned with each other along an axis which approximately intersects the core axis, the said outwardly extending elements of each bent rod being in abutting relationship with, and bonded to, corresponding outwardly extending elements of the other bent rod.

3. A reel for a chain or the like comprising a core portion adapted to have a chain wound around it and a pair of flange portions arranged at opposite ends of the core portion for retaining the chain on the core portion, wherein the reel has an axis of rotation, the core and flange portions are constituted by a pair of bent rods bonded together, wherein the number of bent rods in the reel is limited to two, and wherein each bent rod comprises at least two substantially parallel core-forming elements spaced from each other, the two substantially parallel core-forming elements of each bent rod being spaced from and arranged substantially parallel to the two substantially parallel core-forming elements of the other bent rod, the core-forming elements, proceeding circumferentially around said axis, being, in sequence, the two core-forming elements of one rod followed by the two core-forming elements of the other rod, and the four core-forming elements being equally spaced from said axis, whereby the core of the reel comprises at least four substantially parallel, spaced core-forming elements, in which one of the core-forming elements of each bent rod comprises a single rod element and the other core-forming element of the same bent rod comprises a pair of parallel rod elements, adjacent to each other but spaced from said single rod element, and in which each of said bent rods has flange-forming elements at both ends of the core portion, the flange-forming elements at each end of each bent rod comprising a reinforming element directly connecting one end of the single rod element to an end of one of the parallel adjacent rod elements.

4. A reel according to claim 3 in which, in each bent rod, said single rod element, said one of the parallel adjacent rod elements and said reinforcing elements form a closed loop.

* * * * *